US006036132A

United States Patent [19]

Fritzson

[11] Patent Number: 6,036,132

[45] Date of Patent: Mar. 14, 2000

[54] AIR FLOW DISRUPTOR IN YARN FEEDER

[75] Inventor: Joachim Fritzson, Ulricehamn, Sweden

[73] Assignee: IRO AB, Ulricehamn, Sweden

[21] Appl. No.: 09/142,442

[22] PCT Filed: Mar. 7, 1997

[86] PCT No.: PCT/EP97/01170

§ 371 Date: Jan. 21, 1999

§ 102(e) Date: Jan. 21, 1999

[87] PCT Pub. No.: WO97/33025

PCT Pub. Date: Sep. 12, 1997

[30] Foreign Application Priority Data

Mar. 8, 1996 [DE] Germany ..... 196 09 095

[51] Int. Cl.[7] ..... D03D 47/36

[52] U.S. Cl. ..... 242/364.8; 139/452

[58] Field of Search ..... 242/364.8, 365.3, 242/365.1; 139/452

[56] References Cited

U.S. PATENT DOCUMENTS

| | | | |
|---|---|---|---|
| 4,325,520 | 4/1982 | Hintsch | 139/452 |
| 4,429,723 | 2/1984 | Maroino | 139/452 |
| 4,811,762 | 3/1989 | Bucher et al. | 139/452 |
| 4,852,617 | 8/1989 | Hamer et al. | 139/452 |
| 4,865,085 | 9/1989 | Ghiardo | 139/452 |
| 4,936,356 | 6/1990 | Ghiardo | 139/452 |
| 5,441,087 | 8/1995 | Alberyd et al. | 139/452 |

FOREIGN PATENT DOCUMENTS

| | | |
|---|---|---|
| 0 049 896 A1 | 4/1982 | European Pat. Off. . |
| 0 165 366 A1 | 12/1985 | European Pat. Off. . |
| 0 327 973 A1 | 8/1989 | European Pat. Off. . |
| 0 401 699 A2 | 12/1990 | European Pat. Off. . |
| 33 24 947 C1 | 10/1984 | Germany . |
| 2 069 184 | 8/1981 | United Kingdom . |

*Primary Examiner*—Donald P. Walsh
*Assistant Examiner*—Collin A. Webb
*Attorney, Agent, or Firm*—Flynn, Thiel, Boutell & Tanis, P.C.

[57] ABSTRACT

A yarn feeder including a storage drum which is held in a stationary manner on a housing, a rotatable winding tube disposed between the housing and the storage drum and having an outwardly facing yarn exit, and a bracket which is rigid with the housing. An opto-electronic sensor is provided at the bracket in alignment with a light inlet/exit zone. At least one wind deflector is provided between the yarn exit and the light inlet/exit zone. The deflector protrudes outwardly beyond the light inlet/exit zone to guide an air stream emerging from yarn exit away from the light inlet/exit zone.

20 Claims, 2 Drawing Sheets

AIR FLOW DISRUPTOR IN YARN FEEDER

FIELD OF THE INVENTION

The present invention relates to a yarn feeder including a storage drum supported by a housing, and a rotatable tube for winding yarn on the storage drum which defines a yarn exit between the housing and storage drum. An opto-electronic sensor associated with a light inlet/exit zone is supported on the housing to monitor the yarn as same exits the winding tube and winds on the storage drum.

BACKGROUND OF THE INVENTION

FIG. 9 of (EP-A-0327973, illustrates such a yarn feeder wherein during rotation of the winding-on tube, due to the running motion of the wound-on yarn in relation to the winding on or winding tube and due to centrifugal forces, a forceful air stream exits through the yarn exit of the winding-on tube. This air stream unavoidably carries contaminants and yarn parts which then deposit at the yarn feeder and in the surrounding areas. In a bracket extending alongside the storage drum opto-electronic sensors are received and desire information from the motion of the yarn and/or presence or absence of the yarn in detection zones for controlling the winding-on drive and for further control functions. There opto-electronic sensors mostly operate with light reflection. In the known yarn feeder (EP-A-0327973, FIG. 9) among others, an opto-electronic sensor is provided in a sensor housing received in the bracket and aligned with a winding-on region of the storage drum in order to scan the frontmost yarn windings and to e.g. detect and signal a yarn breakage. The light inlet/exit zone of the opto-electronic sensor, e.g. a window, is imparted by the contaminated air stream when the yarn-winding-on tube is rotating. The contaminants unfortunately tend to deposit on the light inlet/-exit zone and cause deterioration of the optical scanning properties thereof. The same problem also occurs with opto-electronic sensors provided which are at a greater distance (in the axial direction of the storage drum) downstream of the yarn exit. In order to guarantee the operational reliability of the opto-electronic sensors, frequent cleaning operations are needed, e.g. by sweeping or with pressurised air.

It is a task for the invention to create a yarn feeder of the above type in which the operational reliability of the opto-electronic sensors is guaranteed for long operating durations, or in which time periods between cleaning cycles are considerably extended.

This task can be achieved by providing a wind or air deflector between the yarn exit and the light inlet/exit zone.

The air stream exiting the yarn exit is hindered by the wind deflector from depositing the contaminants therein at the light inlet/-exit zone which, therefore, remains free of contaminants or requires cleaning operations only in considerably extended time periods. The contaminants either pass the light inlet/-exit zone without depositing there, or are collected at a side of the wind deflector remote from the light inlet/-exit zone where they are of no harm and are removed in irregular time periods by the air stream itself.

It is suitable to arrange the windows constituting the inlet/-exit zone leeward of the wind deflector to hinder the deposit of contaminants. Since in most cases the yarn feeder is installed with its bracket on top, nevertheless contaminants passing the wind deflector are automatically removed from the leeward side by gravity or are conveyed by gravity into the air flow moving past the light inlet-exit zone, and are removed then.

In order to avoid the deposit of contaminants which are sidewardly deviated, the wind deflector is provided which has a length greater than the width of the light inlet/-exit zone.

The wind deflector according to the invention is structurally simple, and is provided at the lower side of a sensor housing, and is preferably unitary with this lower side. The lower side of the sensor housing may also contain the light inlet/-exit zone in the form of a window.

In a structurally simple fashion, the above task can be fulfilled by a wind deflector which is designed as a straight wall essentially radially oriented in relation to the axis of the storage drum. It is also possible to design the wind deflector as an inclined wall which is arranged counter to or in the flow direction of the air stream, and/or provide the wind deflector with a saw-tooth or curved cross section.

The function of maintaining the light inlet/-exit zone in a clean condition is further improve when the wind deflector has a V-or C shaped form. The height of the wind deflector should essentially correspond to the width of the light inlet/-exit zone. The distance between the wind deflector and the light inlet/-exit zone may be smaller than the height of the wind deflector. In case that the free edge of the wind deflector is formed as a flow break off edge, the air stream advantageously will leave the wind deflector rapidly and contaminants cannot be deposited at the light inlet/-exit zone. In order to accordingly equip yarn feeders which are currently with such a wind or use deflector, the wind deflector may constitute a plastic or metal form part which can be attached at the sensor housing, e.g. by gluing, soldering, screwing or riveting.

BRIEF DESCRIPTION OF THE DRAWINGS

The embodiments of the invention will now be described with reference to the drawings in which.

DETAILED DESCRIPTION

Figure 1:
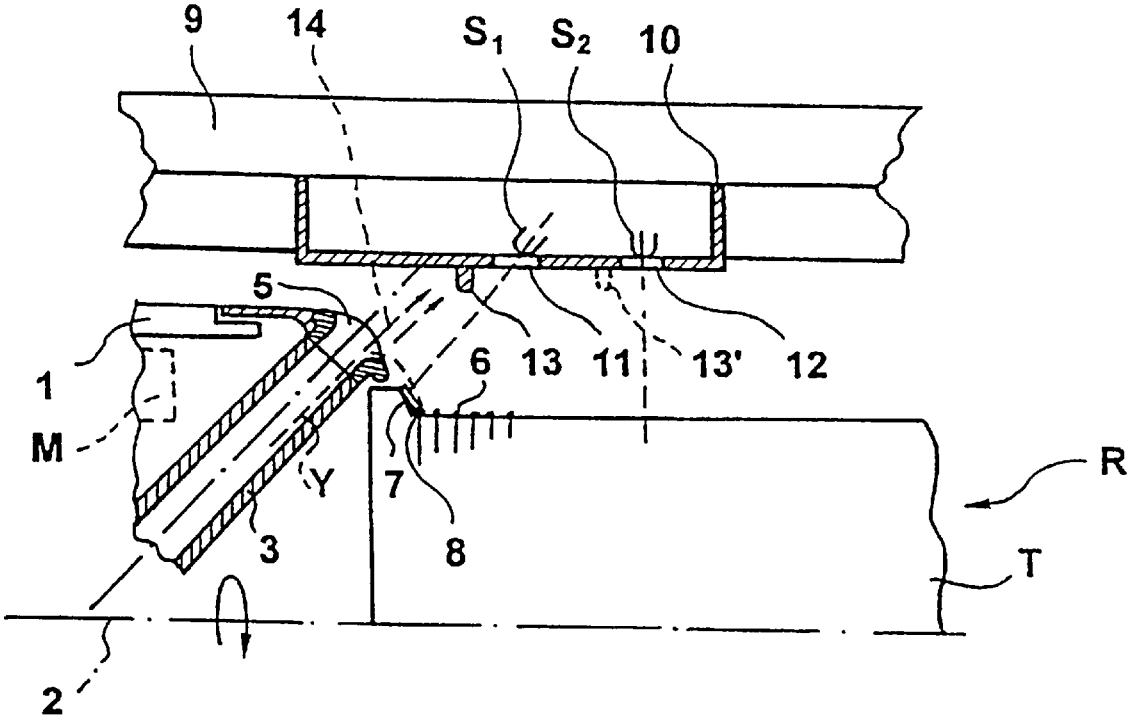
FIG. 1 shows a schematic partial section of a yarn feeder having a wind deflector upstream of a light inlet/-exit zone.

A yarn feeder R in FIG. 1 has a stationary housing 1 which receives a drive motor M, and supports a storage drum T. The yarn feeder R can be used as a weft yarn—storing and feeding device for weaving machines (not shown). The storage drum T is rotatably supported by a main drive shaft 2 (illustrated diagrammatically by its axis) and is hindered by means, e.g. magnets, in (not shown) a conventional fashion from rotating with the rotating drive shaft 2. A winding or winding tube 3 is fixed to the drive shaft 2. The winding-on tube 3 projects obliquely outwardly from the axis of main shaft 2 and carries at its free end an eyelet defining a yarn exit 5. In FIG. 1, the yarn Y is inserted at the left side into the hollow main drive shaft 2, extends through the winding-on tube 3 and exits via yarn exit 5, where the yarn is then deflected towards the surface of the storage drum T and laid down on the surface in windings 6. A textile machine (not shown) consumes the yarn supply consisting of the windings 6 upon demand.

A bracket 9 extending alongside of and outside the storage drum T is connected with housing 1. A sensor housing 10 containing several optoelectronic sensors S and S2 is arranged at bracket 9; at the lower side thereof and facing the surface of the storage drum T. In a winding-on region 7, e.g. of conical shape, of storage drum T, a reflecting coating 8 is provided against which the opto-electronic sensor S is directed from the exterior. The opto-electronic sensors monitors the presence of the first yarn winding or windings or the travel of the yarn Y from yarn exit 5 into windings 6. The sensor S (and also sensor S2) is received inside sensor housing 10, behind a light inlet/-exit zone 11 or 12, respectively, formed as a window. The light inlet/-exit zone 11 or 12 lies in the lower side of the sensor housing 10. During operation of the yarn feeder R and with the rotation of yarn winding-on tube 3, a forceful air stream 14 occurs which carries contaminants such as yarn parts, particles of an impregnation substance, and the like. The air stream 14 is directed against the lower side of the sensor housing 10 and, therefore, acts against the light inlet/-exit zone 11 and forcibly deposits contaminants there.

In order to prevent these deposits from occurring a wind deflector 13 provided. The wind deflector 13 is located in the axial direction of storage drum T between yarn exit 5 and the light inlet/-exit zone 11 and is protrudes over said light inlet/-exit zone 11 in a direction towards the storage drum T. The wind deflector 13 can be unitary or integral with the lower side of sensor housing 10. It is also possible to manufacture the wind deflector 13 as a form part and to fix it at the lower side of a sensor housing. The wind deflector 13 is designed and arranged such that the light inlet/-exit zone 11 is located leeward or downstream of deflector 13 (with respect to air stream 14) and such that the air stream 14 is disturbed, formed into vortexes or diverted at the wind deflector 13 so that airstream 14 is unable to act directly against the light inlet/-exit zone 11.

Figure 2:
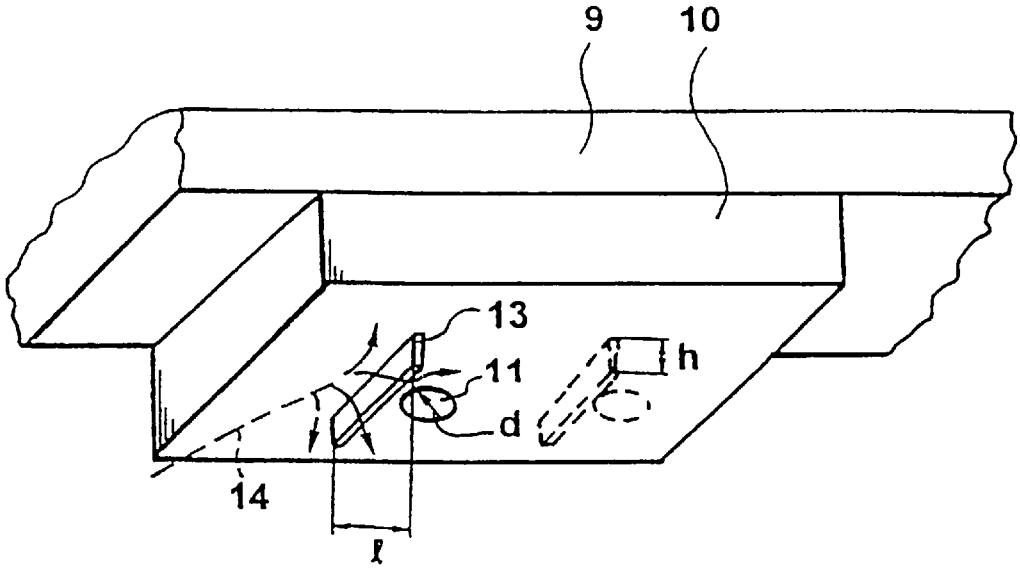
FIG. 2 shows a perspective view of a sensor housing from the lower side thereof, according to FIG. 1.

FIG. 2 shows that the wind deflector 13 is embodied by an essentially radial wall having a length which is greater than the width d of the light inlet/-exit zone 11 (length of wind deflector 13 should at least equal its height h which essentially corresponds with the width d of the light inlet/-exit zone 11). The distance as measure in the axial direction between wind deflector 13 and the light inlet/-exit zone 11 preferably is smaller than the height h of the wind deflector 13.

FIGS. 1 and 2 also illustrated other light inlet/-exit zones, e.g. 12, located further downstream, and associated with further sensors, e.g. S2, which zones are shielded by a means of an upstream positioned wind deflector 13'. Of particular importance, however, is the wind deflector 13 closest to the light inlet/-exit zone 11 nearest t o yarn exit 5, since this zone tends to receive the most contaminants. In most cases, the first wind deflector 13 is sufficient also to avoid the contamination of sensor windows—e.g. 12, provided further downstream.

Figure 3H:
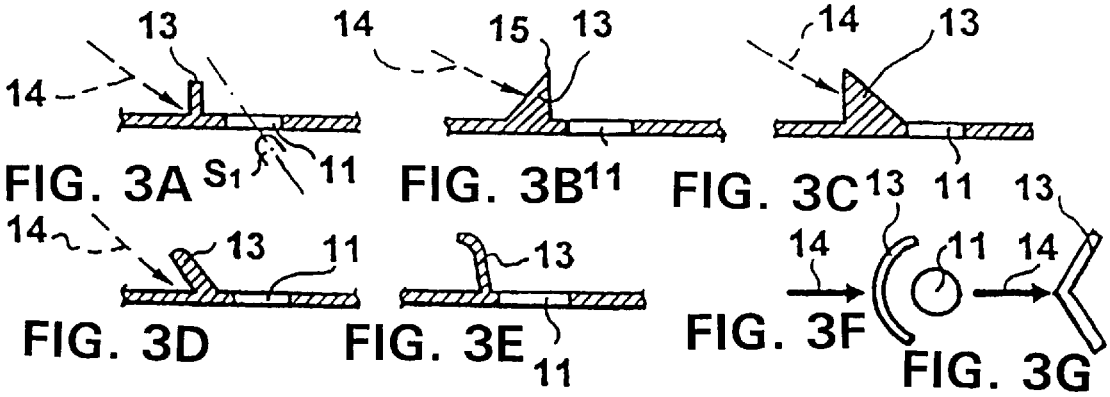
FIGS 3A, 3B, 3C, 3D, and 3E show sectional views of variations of the wind deflector.
FIGS. 3F, 3G and to 3H show plane views of additional variations of wind deflectors.
Figure 3H:
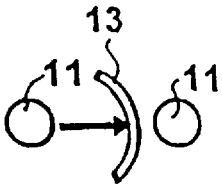

FIGS. 3A–3H illustrate variations of the wind deflector 13. In FIG. 3A wind deflector 13 is a straight, essentially radial wall facing against the air stream 14 such that the light inlet/-exit zone 11 lies in the leeward wind shade of or downstream of wind deflector 13. In FIG. 3B the wind deflector 13 cross section, and the inclined side of the wind deflector 13 faces or opposes air stream 14. Alternatively, according to the embodiment of FIG. 3C the essentially radial side of deflector 13 faces or opposes air stream 14. In FIG. 3D the wind deflector 13 is oriented obliquely against the direction of the air stream 14. It further is possible to arrange the deflector 13 opposite to that shown in FIG. 3D such that the wind deflector 13 somewhat hangs over the light inlet/-exit zone 11. In FIG. 3E the wind deflector 13 is provided with an arc-shaped or terminal-shaped curved cross section. The hook end of the hook can extend in a direction opposite to the air stream 14 or alternately in the direction of the air stream 14 (flow-break off edge).

In FIG. 3F, in a plane view onto the lower side of sensor housing 19, the wind deflector 13 is illustrated as having a C-shaped configuration with its convexly curved side arranged to counter or oppose the air stream 14. In FIG. 3G the wind deflector 13 the shape of an arrow or V such that either the point of the arrow is oriented in opposition to the air stream 14, or alternatively the opposite side of the point may be oriented in opposition to the air stream 14 (not shown). In FIG. 3H an inverse mounting position of the C-shaped wind deflector 13 as shown in FIG. 3F is illustrated.

The wind deflector 13 is preferably unitary or integral with the lower side of the sensor housing 10. It is also possible to separately manufacture the deflector 13 as a plastic- or metal form part and then to attach the wind deflector 13 at the lower side of the sensor housing, e.g. by gluing, screwing, soldering, riveting or the like, e.g. in order to later equip or retrofit yarn feeders currently in use.

For a window with a width of approximately 4 mm to 7 mm as the light inlet/-exit zone 11 (in round or square form), the wind deflector 13 can have a length up to 20 mm, a height h of about 4 mm and a thickness of about 1.5 mm. The longitudinal extension or length should at least correspond to the width d of the light inlet/exit zone.

Although particular preferred embodiments of the invention have been disclosed in detail for illustrative purposes, it will be recognized that variations or modifications of the disclosed apparatus, including the rearrangement of parts, lie within the scope of the present invention.

I claim:

1. A yarn feeder comprising:

a housing;

a storage drum stationarily supported on said housing and defining an axis;

a winding member supported for rotation relative to said drum for winding a yarn around said drum, said winding member defining a yarn exit opening disposed between said housing and said drum; and a sensor arrangement supported on said housing and including a wall in which a window is disposed, said window facing a surface area of said drum on which yarn from said winding member is wound, said sensor arrangement also including an opto-electric electronic sensor disposed to direct light through said window and toward said surface area of said drum; and a deflector stationarily disposed axially between said yarn exit opening and said window and projecting outwardly away from said window in a direction toward said surface area of said drum to direct an air stream emerging from said yarn exit opening away from said window.

2. The yarn feeder of claim 1 wherein said deflector has a length defined in a circumferential direction of said drum which is greater than a width of said window.

3. The yarn feeder of claim 1 wherein said wall defines a lower side of a sensor casing which is mounted on said housing, said lower side being adjacent but opposite said surface area of said drum, said deflector being integral with said lower side, and said window being provided in said lower side.

4. The yarn feeder of claim 1 wherein said deflector comprises a straight wall oriented essentially radially with respect to the axis of said drum.

5. The yarn feeder of claim 1 wherein said deflector comprises a straight wall which defines a positive or negative acute angle with a radial plane which transversely intersects the axis of said drum.

6. The yarn feeder of claim 1 wherein said deflector has a saw tooth-like cross-section.

7. The yarn feeder of claim 1 wherein said deflector has a curved cross-section.

8. The yarn feeder of claim 1 wherein said deflector, when viewed in a direction from the drum toward the deflector, has a generally V- or C-shaped configuration.

9. The yarn feeder of claim 1 wherein said deflector has a height dimension, in the direction toward the surface area of the drum, which substantially corresponds to a width dimension of said window.

10. The yarn feeder of claim 1 wherein a distance between said deflector and said window, as measured in a direction generally parallel to the axis of said drum, is less than a height of said deflector.

11. The yarn feeder of claim 1 wherein said deflector includes a first end connected to said wall and a second free end spaced from said first end, said second free end defining thereon a break-off edge configured for rapidly deflecting the air stream emerging from said yarn exit opening away from said window.

12. The yarn feeder of claim 1 wherein said deflector is a plastic or metal component which is separate from said wall and is attached thereto.

13. The yarn feeder of claim 1 wherein said window is constructed of a material which permits light to pass therethrough, said deflector projecting generally radially beyond said window toward said surface area of said drum.

14. The yarn feeder of claim 13 wherein said deflector has a height defined in a generally radial direction relative to the axis of said drum and a length defined in a generally circumferential direction of said drum, said height and length of said deflector being at least equal to a width dimension of said window.

15. The yarn feeder of claim 13 wherein said deflector includes a wedge-shaped wall structure defined by a generally radial surface which faces toward one of said window and said yarn exit opening and an inclined surface disposed opposite said radial surface and facing the other of said window and said yarn exit opening.

16. The yarn feeder of claim 13 wherein said deflector includes a straight wall structure which projects radially from said wall toward said drum, said wall structure has a first end connected to said wall and a second free end spaced from said first end, said second free end having a hook-like configuration which curves toward one of said window and said yarn exit opening.

17. The yarn feeder of claim 13 wherein said deflector includes a straight wall structure which is inclined relative to said wall such that said wall structure angles either away from or toward said window as said wall structure projects away from said wall.

18. The yarn feeder of claim 13 wherein said deflector includes a wall structure having an arcuate configuration defined by oppositely facing convex and concave radially extending surfaces, said convex surface facing one of said window and said yarn exit opening and said concave surface facing the other of said window and said yarn exit opening.

19. The yarn feeder of claim 13 wherein said deflector includes a wall structure having a V-shaped configuration with an apex which faces one of said window and said yarn exit opening.

20. The yarn feeder of claim 1 wherein said wall defines a plane in which said window is disposed, said plane being generally parallel to a plane tangential to an outer circumferential surface of said drum, and said deflector protruding transversely outwardly beyond said plane defined by said wall radially toward the surface area of said drum.

* * * * *